US005561489A

United States Patent [19]

Yamaguchi et al.

[11] Patent Number: 5,561,489

[45] Date of Patent: Oct. 1, 1996

[54] AUTOMATIC FILM DEVELOPING APPARATUS AND FILM WIND-UP MECHANISM USED IN THE SAME

[75] Inventors: Takuji Yamaguchi; Masasuke Funase, both of Wakayama, Japan

[73] Assignee: Noritsu Koki Co., Ltd., Wakayama, Japan

[21] Appl. No.: 419,928

[22] Filed: Apr. 11, 1995

[30] Foreign Application Priority Data

Apr. 13, 1994 [JP] Japan ..... 6-074821
Apr. 13, 1994 [JP] Japan ..... 6-074822

[51] Int. Cl.[6] ..... G03D 3/08

[52] U.S. Cl. ..... 396/567; 396/612

[58] Field of Search ..... 354/298, 319–324, 354/334, 339, 341; 355/40, 41, 27–29

[56] References Cited

U.S. PATENT DOCUMENTS 5,447,827 9/1995 Ishikawa et al. ..... 354/120 X 5,450,153 9/1995 Matsumoto ..... 354/298

FOREIGN PATENT DOCUMENTS 6-35123 2/1994 Japan .

*Primary Examiner*—D. Rutledge

*Attorney, Agent, or Firm*—Armstrong, Westerman, Hattori, McLeland & Naughton

[57] ABSTRACT

An automatic film developing apparatus for developing a photographic film being guided by a leader, comprising a film separating and forming mechanism for separating the developed film conveyed from the developing section of the apparatus from the leader, and forming the separated portion of the film into a specified shape. The developed film is automatically separated from the leader by the film separating and forming mechanism, and, at the same time, the separated portion is formed in a predetermined shape so as not to be caught in the guide of the negative mask or in a predetermined shape so as to be easily wound up in the cartridge, thereby saving the labor and enhancing the job efficiency.

6 Claims, 7 Drawing Sheets

AUTOMATIC FILM DEVELOPING APPARATUS AND FILM WIND-UP MECHANISM USED IN THE SAME

BACKGROUND OF THE INVENTION

The present invention relates to an automatic film developing apparatus and a film wind-up mechanism used in the same apparatus. More particularly, it relates to an automatic film developing apparatus for conveying an exposed film by a leader connected to the end thereof, and developing it, and a film wind-up mechanism used in the apparatus.

As an automatic film developing apparatus, a developing apparatus of leader conveying system is known. In the developing apparatus, after adhering a leader to the end of an exposed photographic film, the film is guided by the to be developed. The developed film is processing vessels to be developed. The developed film is once discharged into an exclusive stocker.

The film is, however, taken out again from the stocker by the operator, and is separated from the leader. This separating job is done by means of scissors or the like in order to cut into a shape so that the film might not be caught in the guide of the negative mask or the like in printing (for example, corners of both ends are chamfered). However, when wind up the film on a shaft (spool ) in a film cartridge (hereinafter referred to "cartridge " simply), the cut end of the film is formed by means of a punch or the like so as to be formed into shape to be easily hooked on the spool (for example, two holes for hooking are formed).

Such film separating job and forming job and subsequent winding of film on the cartridge are carried out by the operator, and it takes much time and labor, and the working efficiency is not good.

In the light of the above circumstance, it is hence a primary object of the present invention to present an automatic film developing apparatus capable of separating the developed film from the leader, and forming the film automatically.

It is another object of the present invention to present a film wind-up mechanism capable of winding up the film automatically into a cartridge, after separating the developed film from the leader and forming the film.

SUMMARY OF THE INVENTION

In accordance with the present invention, there is provided an automatic film developing apparatus for developing a photographic film being guided by a leader, comprising a film separating and forming mechanism for separating the developed film conveyed from a development part of the apparatus from the leader, and forming the separated portion of the film into a predetermined shape.

In the invention, the film separating and forming mechanism preferably comprises a reshape die moved up and down by an eccentric cam, a receiving die disposed oppositely to the reshape die, and a detector for detecting the rear end of the leader.

In accordance with the present invention, there is also provided a film wind-up mechanism comprising a detector for detecting an ID number indicated on a film, a film guide mechanism for guiding a front end of the film to insert into a spool in a cartridge, and a drive mechanism for winding up the film on the spool.

The film guide mechanism preferably includes a rotatable tongue to be engaged with holes opened in the film.

The drive mechanism preferably comprises a spool drive motor for driving a spool drive shaft to be fitted into a key groove in a spool of the cartridge, a light shielding door opening and closing drive motor for driving a door drive shaft to be fitted into a key groove of a light shielding door, and a slide motor for sliding the both motors relative to the side surface of the cartridge.

It is also preferred that the film wind-up mechanism includes a cartridge holder accommodating a plurality of cartridges for conveying a cartridge having a same ID number as the ID number of the film into a film inserting position, on the basis of the ID number indicated on each cartridge.

The detector is preferred to be provided in the film separating and forming mechanism for separating the developed film conveyed from the development part from the leader, and forming the separated portion of the film into a predetermined shape, in an automatic film developing apparatus for developing a photographic film guided by the leader.

According to the automatic film developing apparatus of the present invention, after developing process, the film is separated from the leader and the separated portion of the film is formed simultaneously by the film separating and forming mechanism. Afterwards, the film and leader are stored separately. Since the separated portion of the film is formed into a shape, it can be easily taken up on the cartridge, so that the labor can be saved.

Also according to the film wind-up mechanism of the present invention, the ID number of the developed film is detected, and the film is automatically wound up on a cartridge corresponding to the detected ID number by means of the film wind-up mechanism. In the automatic film developing apparatus, moreover, when the leader is separated from the film, the separated portion is formed simultaneously, and then the film can be easily wound up on the cartridge by the film wind-up mechanism, so that the labor can be saved.

DETAILED DESCRIPTION

Figure 1:
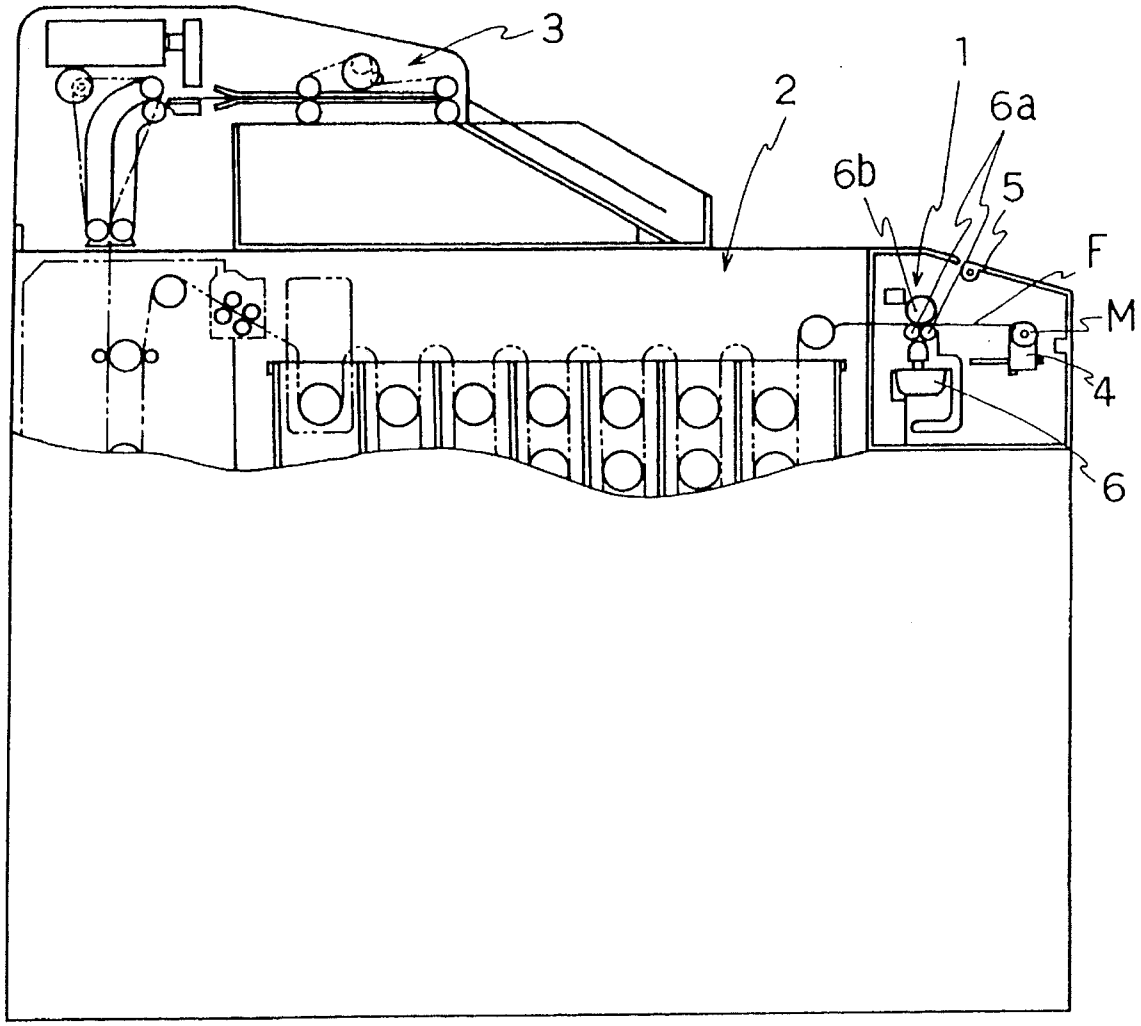
FIG. 1 is an explanatory view showing an embodiment of an automatic film developing apparatus of the present invention.

Referring now to the drawings, an automatic film developing apparatus and a film wind-up mechanism used in the apparatus of the present invention are described in detail below.

As shown in FIG. 1, an automatic film developing apparatus comprises a leader inserting part 1, a development section 2, and a film processing part 3.

Figure 3:
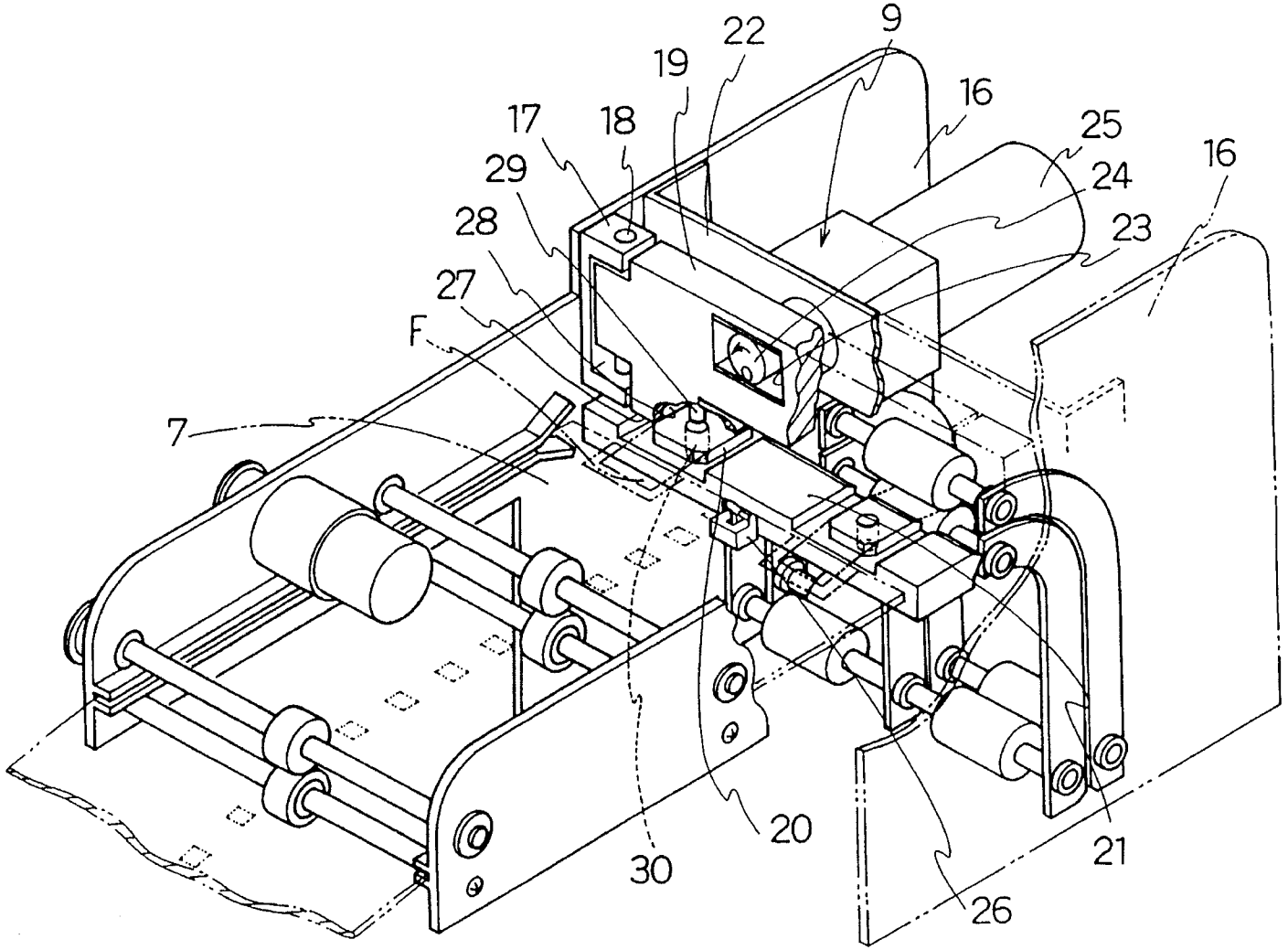
FIG. 3 is a perspective view of a film separating and forming mechanism in FIG. 2.

First, the rear end of a film F is fixed in a spool of a cartridge, so that, as pretreatment before developing process, the film F and cartridge are separated from each other, and the film F is wound up in a magazine M. To the front end of the film F wound up in the magazine M, a leader 7 shown in FIG. 3 is connected by means of a splice tape.

In the leader inserting part 1, the spliced film F and the leader 7 are set on a support stand 4, and a cover 5 is closed. Then, a pressurizing solenoid 6 is energized to compress a pressurizing roller 6*a*, and the film F connected to the leader 7 is sent into the development part 2 by means of a feed roller 6*b*.

The development part 2 accommodates various processing vessels for developing solution, fixing solution, etc., and by feeding the leader 7 by sprocket, the film F is developed, dried in a drying chamber, and is conveyed into the film processing part 3.

Figure 2:
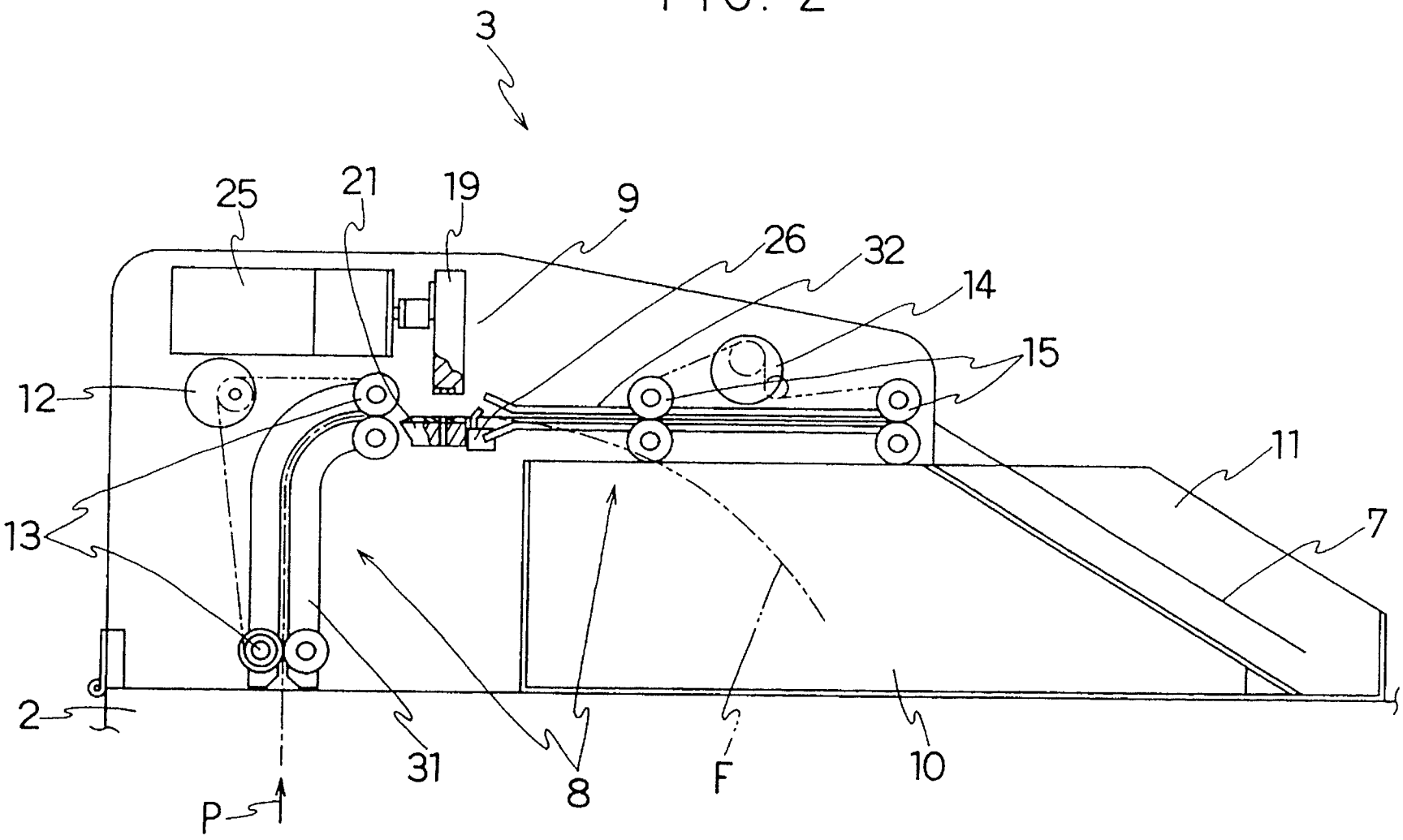
FIG. 2 is an enlarged view of a film processing part in FIG. 1.

The film processing part 3 comprises, as shown in FIG. 2, a conveying mechanism 8 for conveying the film F and leader 7, a film separating and forming mechanism 9 for separating the film F and leader 7, and simultaneously forming the separated portion of the film into a desired shape, and a film stocker 10 and a leader stocker 11 for storing the separated film F and leader 7, respectively.

The conveying mechanism 8 comprises a film conveying motor 12 and a film conveying roller 13 for sending out the film F, and a leader conveying motor 14 and a leader conveying roller 15 for sending out the leader 7.

The film separating and forming mechanism 9 comprises, as shown in FIGS. 2 and 3, a reshape die 19 guided by a pin 18 inserted into a c-shaped angle 17 fixed on both frames 16, a base 21 having a receiving die 20 disposed oppositely to the reshape die 19, a drive motor 25 coupled to a bracket 22 straddling and fixed on the both frames 16, and having an eccentric cam inserted into an opening 23 of the reshape die 19, and a detector 26 for detecting the rear end of the leader 7.

At the lower side 27 of the reshape die 19, a recess 28 of approximately the same shape as the receiving die 20 is formed. A protrusion 29 is set up in the recess 28, and is designed to be fitted into a penetration hole 30 which penetrates through the receiving die 20 and base 21.

The reshape die 19 moves up and down by an amount corresponding to the eccentric amount of the eccentric cam 24 by actuating the drive motor 25.

As the detector 26, a photo interrupter, a limit switch or the like can be used.

The operation of the automatic film developing apparatus of the present invention is described below.

First, the film F connected to the leader 7 is sent out from the leader inserting part 1 through each processing vessel and drying chamber in the development section 2 into the film processing section 3 from the direction of arrow P shown in FIG. 2. Then, through a guide 31, it is supported on a leader guide 32.

When the detector 26 once detects the leader 7 and thereafter it stops its detection, it is judged that the rear end of the leader comes, and when the rear end of the connection portion of the leader 7 and film F comes to immediately beneath the reshape die 19, the leader conveying motor 14 and film conveying motor 12 are stopped. Consequently, when the eccentric cam 24 provided in the drive motor 25 is rotated by one revolution, the reshape die 19 descends and ascends. As a result, the film F held between the recess 28 of the reshape die 19 and the receiving die 20 is separated from the leader 7, and corners of both ends are chamfered, and holes are opened. Therefore, the front end of the film F is formed into a shape so as to be easily put into the cartridge. After completion of forming, by rotating the film conveying roller 13 and leader conveying roller 15, the film F is discharged into the film stocker 10 and the leader 7 into the leader stocker 11, respectively, to be stored.

Next is explained an embodiment of a film wind-up mechanism of the present invention which can be applied in the automatic film developing apparatus mentioned above.

Figure 4:
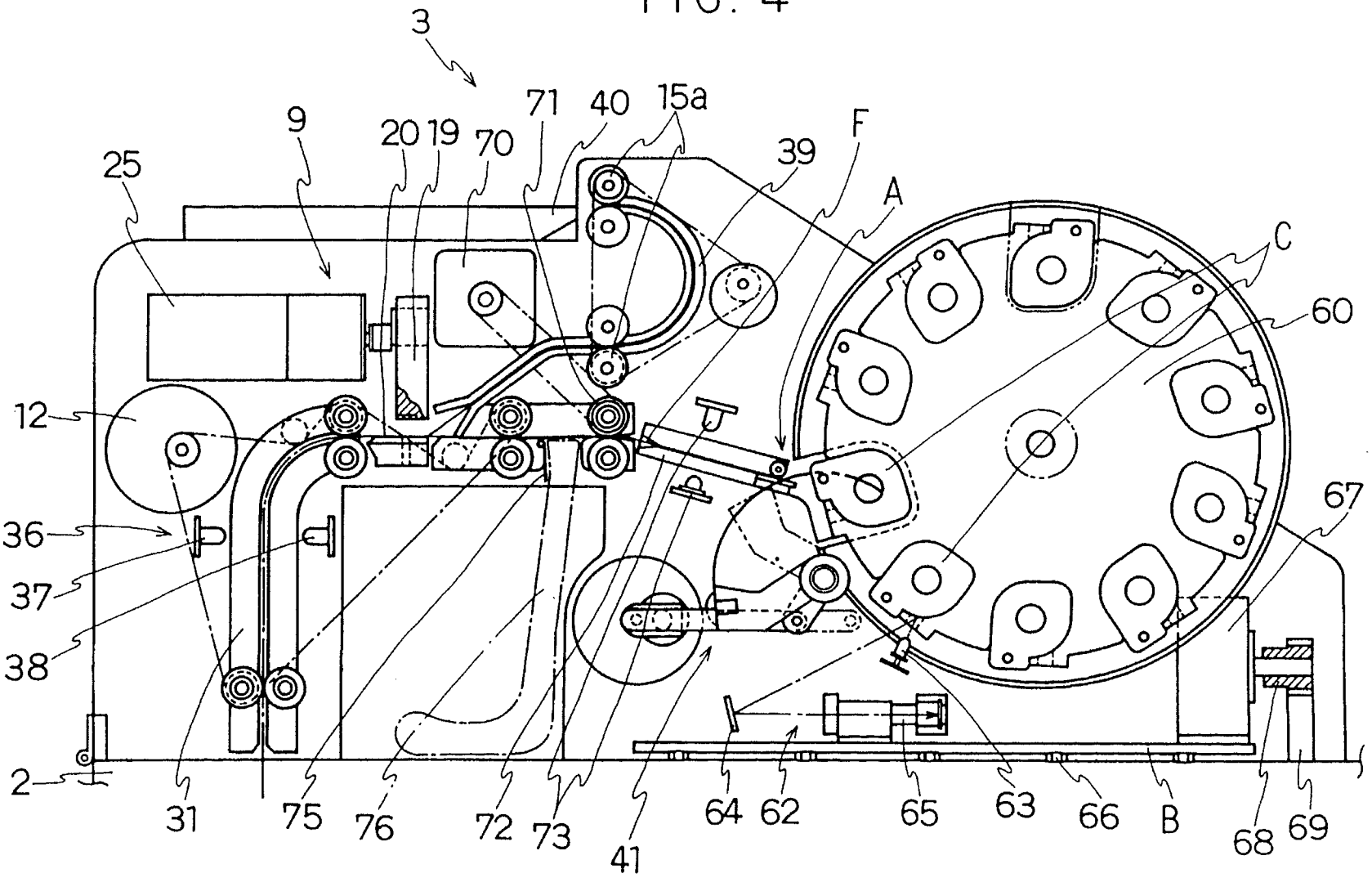
FIG. 4 is an explanatory view showing another embodiment of an automatic film developing apparatus of the present invention.

In a film processing part shown in FIG. 4, a detector is provided in a guide 31. A detector 36 comprises a light emitting device 37 and a photo sensor 38. The detector 36 is an optical sensor having a function for detecting transmissivity of the film for reading the bar code, as well as detecting presence or absence of film. When the film F passing through the processing vessels and drying chamber in the development part 2 is sent into the film processing part 3, the detector 36 detects the front end of the film F, and further the leader 7 is guided into a leader guide 39 curved upward, and the rear end of the connection portion of the film F and leader 7 is conveyed to immediately beneath the reshape die 19. Then actuating the film separating and forming mechanism 9, the film F and leader 7 are separated from each other, and the leader 7 is discharged into a leader stocker 40 by means of leader conveying roller 15*a*. On the other hand, the separated portion of the film F is formed into a predetermined shape.

Figure 5:
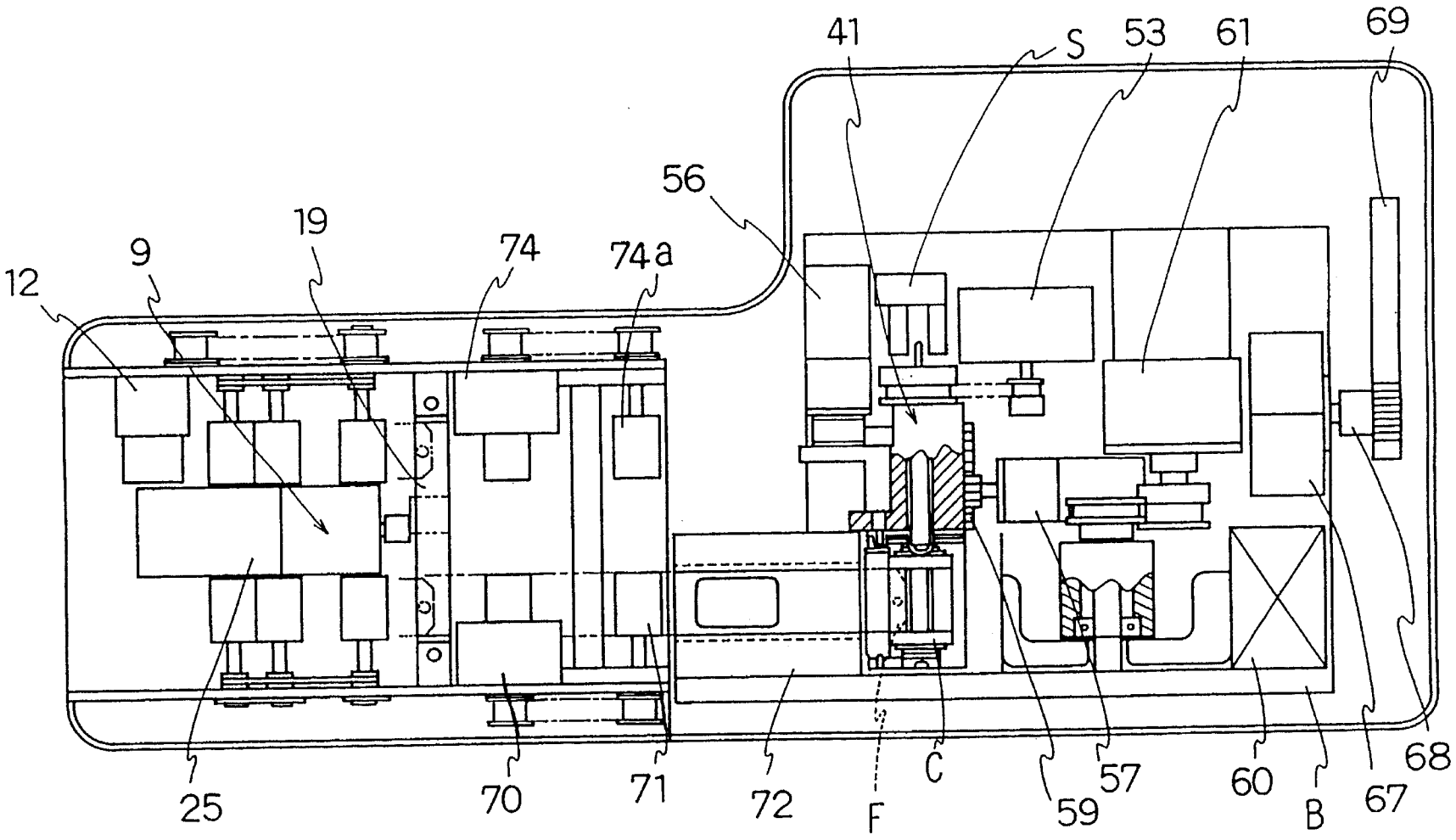
FIG. 5 is a plan view of a film processing part in FIG. 4.
Figure 6:
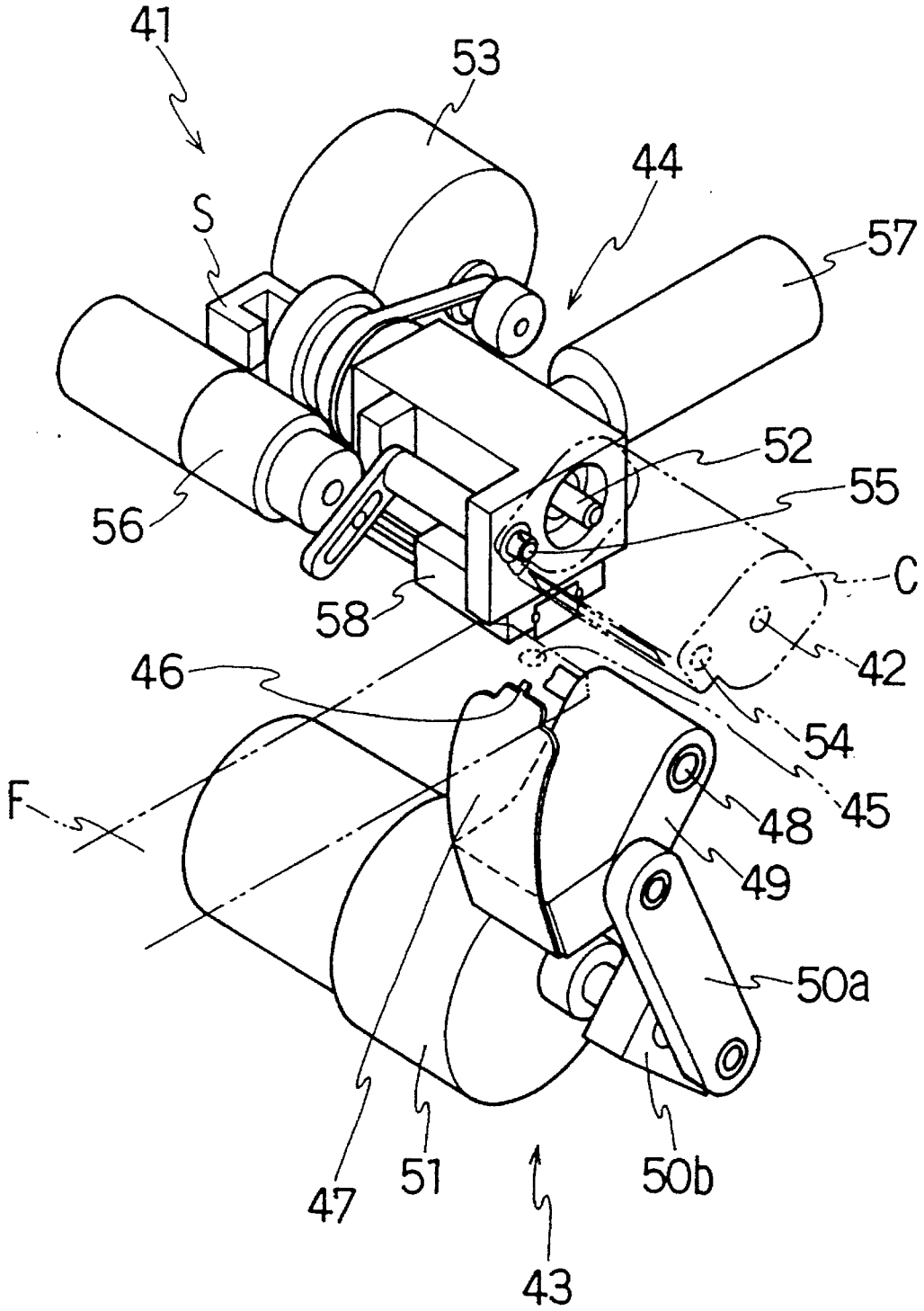
FIG. 6 is an enlarged perspective view of a film wind-up mechanism in FIG. 4.

After forming the film F, it is further wound up on the cartridge C by means of a film wind-up mechanism 41 as shown in FIGS. 4 to 6.

The film wind-up mechanism 41 comprises a detector 36 for detecting the ID number composed of bar code, alphabet or the like indicated on the film F, a film guide mechanism 43 for guiding the front end of the film F to insert it into a spool 42 in the cartridge C, and a drive mechanism 44 for winding up the film F on the spool 42. In the film guide mechanism 43, a film guide tongue 47 having a tongue 46 to be engaged with a hole 45 opened in the film F is fixed in a tongue main body 49 supported by a pin 48, and is designed to rotate about the pin 48 by a drive motor 51 through link members 50a, 50b. The drive mechanism 44 comprises a spool drive motor 53 for driving a spool drive shaft 52 fitted in a key groove of the spool 42 of the cartridge C, a light shielding door opening and closing drive motor 56 for driving a door drive shaft 55 fitted into a key groove of a light shielding door 54, and a slide motor 57 for sliding the both motors relatively to the side surface of the cartridge C. As the slide, a linear bearing 58 and a rack and pinion mechanism 59 are employed.

Figure 7:
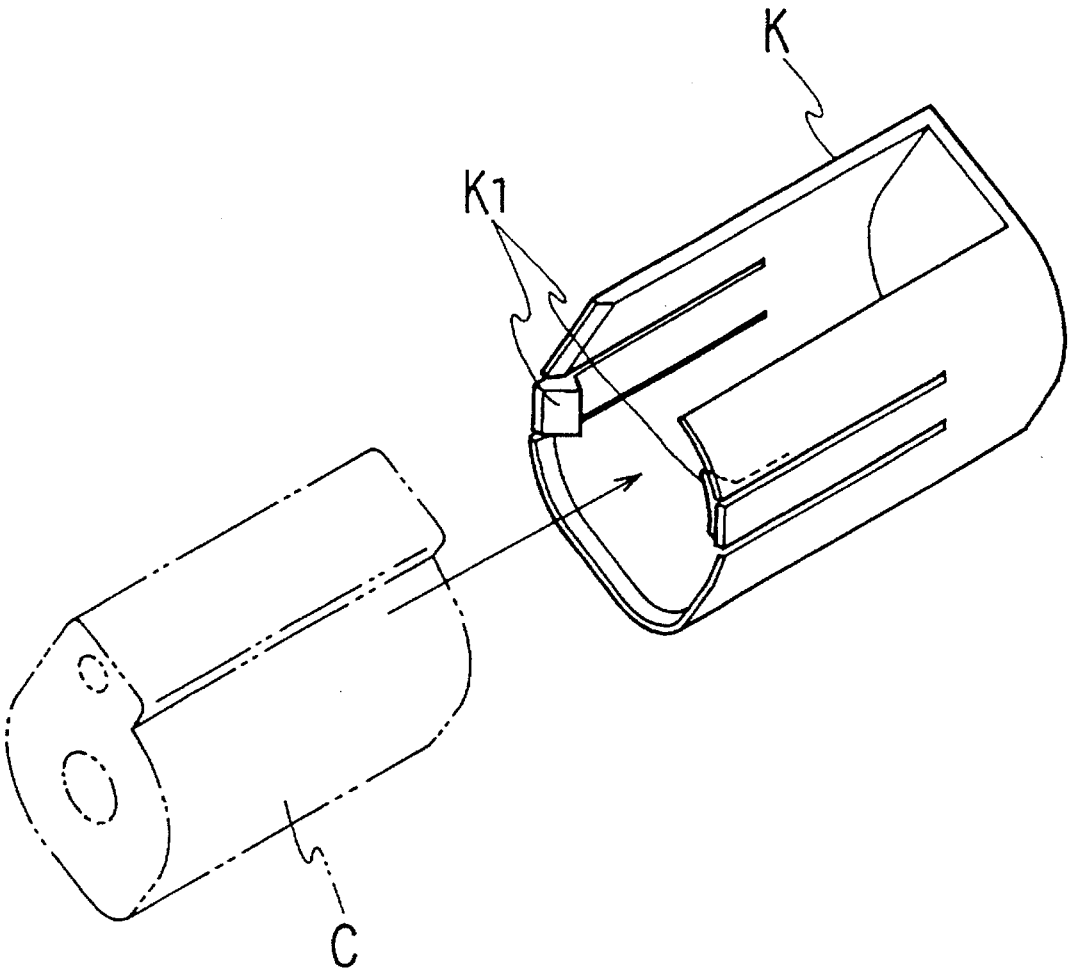
FIG. 7 is an explanatory view showing a case of a cartridge in FIG. 4.

The cartridge C is put in a cartridge holder 60 which can accommodate a plurality of cartridges. When putting it in, meanwhile, if a case K for holding the cartridge C in a holding pawl $K_1$ is shaped to be opened at the drive mechanism 44 side as shown in FIG. 7, the cartridge C can be put in and out, and when the drive mechanism 44 slides, the spool 42 of the cartridge C and the light shielding door 54, and the spool drive shaft 52 and door drive shaft 55 can be coupled. The cartridge holder 60 is supported on a bearing, and is designed to be rotated by a holder drive motor 61. A reading mechanism 62 for reading the ID number marked on the cartridge C, such as bar code, is disposed opposite to the cartridge C. The reading mechanism 62 comprises a light emitting device 63 for emitting light to the ID number, and a CCD camera 65 for recognizing the indication by further reflecting the reflected light by a reflection mirror 64.

The film wind-up mechanism 41, cartridge holder 60, and reading mechanism 62 are set on a bed B on a thrust bearing 66, and are designed to slide simultaneously. As the sliding mechanism, there can be employed a rack and pinion consisting of a pinion 68 of a pinion motor 67 fixed on the bed B, and a rack 69 fixed to a stationary member aside from the bed B.

The operating procedure of the above film wind-up mechanism 41 is described below.

1. The cartridge C showing the ID number corresponding to the film F to be developed is set in the cartridge holder 60.

2. After setting, the cartridge holder 60 is rotated by the holder drive motor 61, and the ID number of each cartridge C is read by the reading mechanism 62 and stored.

3. The film F developed in the development part 2 is conveyed into the film processing part 3.

4. After detecting the front end of the film by the detector 36, the film F is fed by a predetermined length and is stopped thereafter. At this time, the ID numbers of the right and left films F (film $F_R$ and Film $F_L$) connected to the leader 7 as shown in FIG. 3 are read.

5. Driving the drive motor 25 of the film separating and forming mechanism 9, the right and left films F are separated from the leader 7 by means of the reshape die 19 and receiving die 20, and the separated portion of the film F is formed into a predetermined shape.

6. The separated leader 7 is discharged into the leader stocker 40 through the leader conveying roller 15*a*.

7. On the other hand, for example, when the cartridge C showing the same ID number as the left film $F_L$ is near the film insertion position A shown in FIG. 4, the slide drive pinion motor 67 and holder drive motor 61 are actuated on the basis of the detection value of the reading mechanism 62, and the specified cartridge C is disposed at the film $F_L$ side.

8. Afterwards, the spool drive shaft 52 is slided by the slide motor 57 to be inserted into the cartridge C.

9. Rotating the spool drive motor 53, coincidence of the key of the spool drive shaft 52 and the key groove of the spool 42 in the cartridge C is detected by a photo sensor S disposed behind the spool drive shaft 52.

10. The light shielding door 54 of the cartridge C is opened by the light shielding door opening and closing drive motor 56.

11. The spool 42 is positioned by the spool drive motor 53.

12. The front end of the film $F_L$ being conveyed by film conveying motor 70 and film conveying roller 71 is detected by a film detection sensor 73 such as light emitting device disposed at a film guide 72, and is stopped after a predetermined feed.

13. As for the light side film $F_R$, after a predetermined feed, when the front end thereof reaches a film conveying roller 74*a*, a film conveying motor 74 is stopped, and the film conveying motor 12 is driven instead to push and open a valve 75, thereby flowing into a film stocker 76.

14. Driving the drive motor 51, the tongue 46 is engaged with the hole 45 in the film $F_L$, and the film $F_L$ is mounted around the spool 42 in the cartridge C.

15. By the spool drive motor 53, the film $F_L$ is wound up in the cartridge C.

16. The light shielding door 54 is closed by the light shielding door opening and closing drive motor 56.

17. The cartridge C is drawn out of the spool drive shaft 52 by means of the slide motor 57.

18. To process the film $F_R$ stored in the film stocker 76, the film wind-up mechanism 41 is moved to the film $F_R$ side by sliding the bed B. By the film conveying motor 74 and film conveying roller 74*a*, the film $F_R$ is sent out into the film guide 72, and is wound up on the cartridge C in the same procedure.

In succession, the film F being sent into the film processing part 3 is processed same as above.

According to the automatic film developing apparatus of the present invention, as described herein, the developed film is automatically separated from the leader by the film separating and forming mechanism, and, at the same time, the separated portion is formed in a predetermined shape so as not to be caught in the guide of the negative mask or in a predetermined shape so as to be easily wound up in the cartridge, thereby saving the labor and enhancing the job efficiency.

According to the film wind-up mechanism of the present invention described above, the film can be automatically wound up in the cartridge by matching the ID numbers of the film and cartridge.

By installing such film wind-up mechanism into the automatic film developing mechanism having film separating and forming mechanism, the developed film can be automatically separated from the leader, and the separated portion is simultaneously formed into a desired shape, then the film is automatically wound up in the cartridge. Therefore, the labor is saved, and the job efficiency is enhanced.

Though several embodiments of the present invention are described above, it is to be understood that the present invention is not limited only to the above-mentioned and various changes and modifications may be made in the invention without departing from the spirit and scope thereof.

What is claimed is:

1. A film wind-up mechanism comprising a detector for detecting an ID number indicated on a film, a film guide mechanism for guiding a front end of the film to insert into a spool in a cartridge, and a drive mechanism for winding up the film on the spool wherein the drive mechanism comprises a spool drive motor for driving a spool drive shaft to be fitted into a key groove in a spool of the cartridge, a light shielding door opening and closing drive motor for driving a door drive shaft to be fitted into a key groove of a light shielding door, and a slide motor for sliding both motors relative to the side surface of the cartridge.

2. The film wind-up mechanism of claim 1, further comprising a cartridge holder accommodating a plurality of cartridges for conveying a cartridge having a same ID number as the ID number of the film into a film inserting position, on the basis of the ID number indicated on each cartridge.

3. The film wind-up mechanism of claim 1, wherein the film guide mechanism includes a rotatable tongue to be engaged with holes opened in the film.

4. The film wind-up mechanism of claim 3, further comprising a cartridge holder accommodating a plurality of cartridges for conveying a cartridge having a same ID number as the ID number of the film into a film inserting position, on the basis of the ID number indicated on each cartridge.

5. A film wind-up mechanism comprising a detector for detecting an ID number indicated on a film, a film guide mechanism for guiding a front end of the film to insert into a spool in a cartridge, and a drive mechanism for winding up the film on the spool wherein the film guide mechanism includes a rotatable tongue to be engaged with holes opened in the film and wherein the drive mechanism comprises a spool drive motor for driving a spool drive shaft to be fitted into a key groove in a spool of the cartridge, a light shielding door opening and closing drive motor for driving a door drive shaft to be fitted into a key groove of a light shielding door, and a slide motor for sliding both motors relative to the side surface of the cartridge.

6. The film wind-up mechanism of claim 5, further comprising a cartridge holder accommodating a plurality of cartridges for conveying a cartridge having a same ID number as the ID number of the film into a film inserting position, on the basis of the ID number indicated on each cartridge.

* * * * *